US005739774A

United States Patent [19]

Olandesi

[11] Patent Number: 5,739,774

[45] Date of Patent: Apr. 14, 1998

[54] MASS TRANSIT MONITORING AND CONTROL SYSTEM

[76] Inventor: Antonio Carlos Tambasco Olandesi, 167 Dawson Cir., Staten Island, N.Y. 10314

[21] Appl. No.: 679,253

[22] Filed: Jul. 12, 1996

[51] Int. Cl.[6] ..... G08G 1/123

[52] U.S. Cl. ..... 340/994; 340/991

[58] Field of Search ..... 340/994, 991, 340/992, 539, 988; 364/436; 701/117

[56] References Cited

U.S. PATENT DOCUMENTS

| | | | |
|---|---|---|---|
| 4,713,661 | 12/1987 | Boone et al. | 340/994 |
| 4,799,162 | 1/1989 | Shinkawa et al. | 340/994 |
| 4,857,925 | 8/1989 | Brubaker | 340/994 |
| 5,400,020 | 3/1995 | Jones et al. | 340/994 |
| 5,461,374 | 10/1995 | Lewiner et al. | 340/994 |
| 5,483,234 | 1/1996 | Careel et al. | 340/994 |
| 5,493,295 | 2/1996 | Lewiner et al. | 340/994 |

FOREIGN PATENT DOCUMENTS

| | | | |
|---|---|---|---|
| 2559930 | 8/1985 | France | 340/994 |
| 0066175 | 6/1977 | Japan | 340/994 |
| 9313510 | 7/1993 | WIPO | 340/994 |

*Primary Examiner*—Brent A. Swarthout
*Attorney, Agent, or Firm*—Goldstein & Associates

[57] ABSTRACT

A system is disclosed to monitor and coordinate the movement of a plurality of mass transit passenger vehicles servicing a network of pathways. The system will disseminate information such as the on-time status and the expected arrival times of a plurality of the vehicles assigned to and traversing predefined routes within the network. Each route within the network is comprised of a plurality of predetermined passenger drop-off and pickup stops. The system includes of a plurality of stop units, each installed at one of the plurality of the passenger stops within the network, and configured to collect and disseminate information related to vehicle arrivals at the passenger stops. A plurality of vehicle units are provided wherein each is installed in one of the mass transit passenger vehicles operating in the network. The vehicle units are configured to exchange information with the stop units during the interval of time each vehicle unit is in the immediate vicinity of one of the stop units. Computing means are also included to exchange information with a plurality of the stop units to determine the status and timeliness of the mass transit vehicles traversing at least one of the predefined routes.

13 Claims, 7 Drawing Sheets

MASS TRANSIT MONITORING AND CONTROL SYSTEM

BACKGROUND OF THE INVENTION

1. Field of the Invention

The invention relates generally to mass transit control and management systems. More particularly, the invention relates to a system comprised of distributed components for monitoring, coordinating, and disseminating information related to the operation of mass transit vehicles.

2. Background and Objects of the Invention

The efficiency and economic appeal of mass transit systems is well established in the art. This is especially true when considering urban settings. The use of mass transit systems can reduce traffic congestion, lower the volume of pollutants discharged into the air, reduce the amount of fuel consumed, etc. Since such systems are not mandated, they must compete with other forms of transportation, most particularly the ubiquitous private passenger automobile. One area where mass transit systems can improve is by providing consistent and smooth operation and scheduling, whereby the riding public is better served.

Systems are known in the prior art that collect data related to mass transit system operation by monitoring the movement and operation of a plurality of vehicles in operation. Other systems are available which provide communication links for the exchange of information, particularly voice exchanges, between vehicle drivers and individuals responsible for the overall operation of the system or a section thereof. Still, other systems are provided which disseminate information to prospective passengers and riders. However, the above listed inventions do not provide systems that integrate all of these functions in a fundamentally simple structure, and enhance the overall operation of the system.

There are also systems known in the art that include vehicle installed transponders to assist in the monitoring of the flow of vehicular traffic. These systems are configured with a plurality of roadside repeaters to support the exchange of information between a central computer system and a vehicle with a transponder installed therein. Although systems of this type allow information to be collected centrally, and in some cases support the transmission of information back to a vehicle operator, they do not include as part of the system architecture a mechanism to better inform individuals and passengers of vehicle arrival and departure times, particularly when the system includes bus-like vehicles. For example, systems are not known that are capable of supplying information to a succession of passenger pickup and drop-off stops along a predefined route. In addition, systems are not known that provide up-to-date information, such as where the information provided to passengers is updated approximately every few minutes.

Accordingly, a system is desired that can enable the monitoring of vehicle movement (with respect to arrivals at designated and predetermined passenger stops), and simultaneously supply the users of the mass transit system (i.e. passengers or individuals waiting for transport) with helpful information about the on-time status of one or more vehicles scheduled to stop at one or more passenger pickup or drop-off stops. With the current level of technology and the increasing demands placed on present mass transit systems, especially those in dense urban locations, the desired features can be provided by appropriate arrangements employing available technology.

Objects of the present invention are, therefore, to provide new and improved systems for monitoring and coordinating the operation of mass transit vehicles, having one or more of the following capabilities, features, and/or characteristics:

- monitor and collect (remotely) information related to the movement of mass transit vehicles within a network of vehicle pathways;
- disseminate to the riding public information related to the expected arrival times of vehicles at passenger stops along one or more predefined routes within the network;
- a distributed and simple modular system architecture;
- enable specific vehicles in operation on the network of roads to be located and tracked as required;
- supply vehicle operators with information to assist the operators in trying to remain on schedule with respect to the movement of said vehicles when traversing a predefined route; and
- supply passengers, including those waiting at stops, with information related to the movement of vehicles along the respective predefined and assigned routes.

The above listed objects, advantages, and associated novel features of the present invention will become more clear from the description and figures provided herein. Attention is called to the fact, however, that the drawings are illustrative only. Variations are contemplated as being part of the invention, limited only by the scope of the appended claims.

SUMMARY OF THE INVENTION

In accordance with the invention, a system is disclosed to monitor, control, and coordinate the movement of mass transit vehicular traffic in the form of a plurality of mass transit passenger vehicles. The plurality of vehicles are arranged to traverse predefined routes within the network, each route comprised of a plurality of predetermined passenger drop-off and pickup stops. The system includes a plurality of stop units, a plurality of vehicle units, and computing means. The plurality of stop units, each installed at one of the plurality of the passenger drop-off and pickup stops within the network, are configured to collect and disseminate information related to vehicle arrivals at the respective passenger stops. One of the plurality of vehicle units is installed in each mass transit vehicle traveling on the network. Each vehicle unit is configured to exchange information with each stop unit during the interval of time the vehicle unit is in the immediate vicinity of said stop unit. The computing means is in communication with a plurality of the stops units to exchange information to determine the status and timeliness of the mass transit vehicles traversing at least one of the predefined routes. The timeliness of vehicles is related to the actual time a vehicle arrives at a passenger drop-off and pickup stop with respect to the scheduled time of arrival. A schedule adjustment value is determined for each vehicle arriving at the respective passenger stops. The schedule adjustment value may be determined and employed to gauge the on-time status of each of the vehicles in operation within the network.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

In the context of this disclosure the terms "transit system" and "mass transit system" will be defined as any system employing vehicular components, for example bus-like vehicles, which are intended to carry a plurality of passengers. Such vehicles are often operated, contemporaneously in large numbers, wherein each vehicle or plurality of coupled vehicles is operated by a single driver. Also, the terms "mass transit vehicle", "passenger vehicle", and more generally "vehicle" will refer a vehicle that is capable of carrying a plurality of individuals. Further, when describing passenger drop-off and pickup locations, the terms "stop", "passenger stop", and "passenger drop-off and pickup stop" will be used interchangeable and are intended to convey the same meaning. Finally, it should be understood that the vehicles typically travel on dedicated or shared pathways, such as roads or tracks, and a plurality of interconnected pathways will to be defined as a "network" or "network of pathways".

Figure 1:
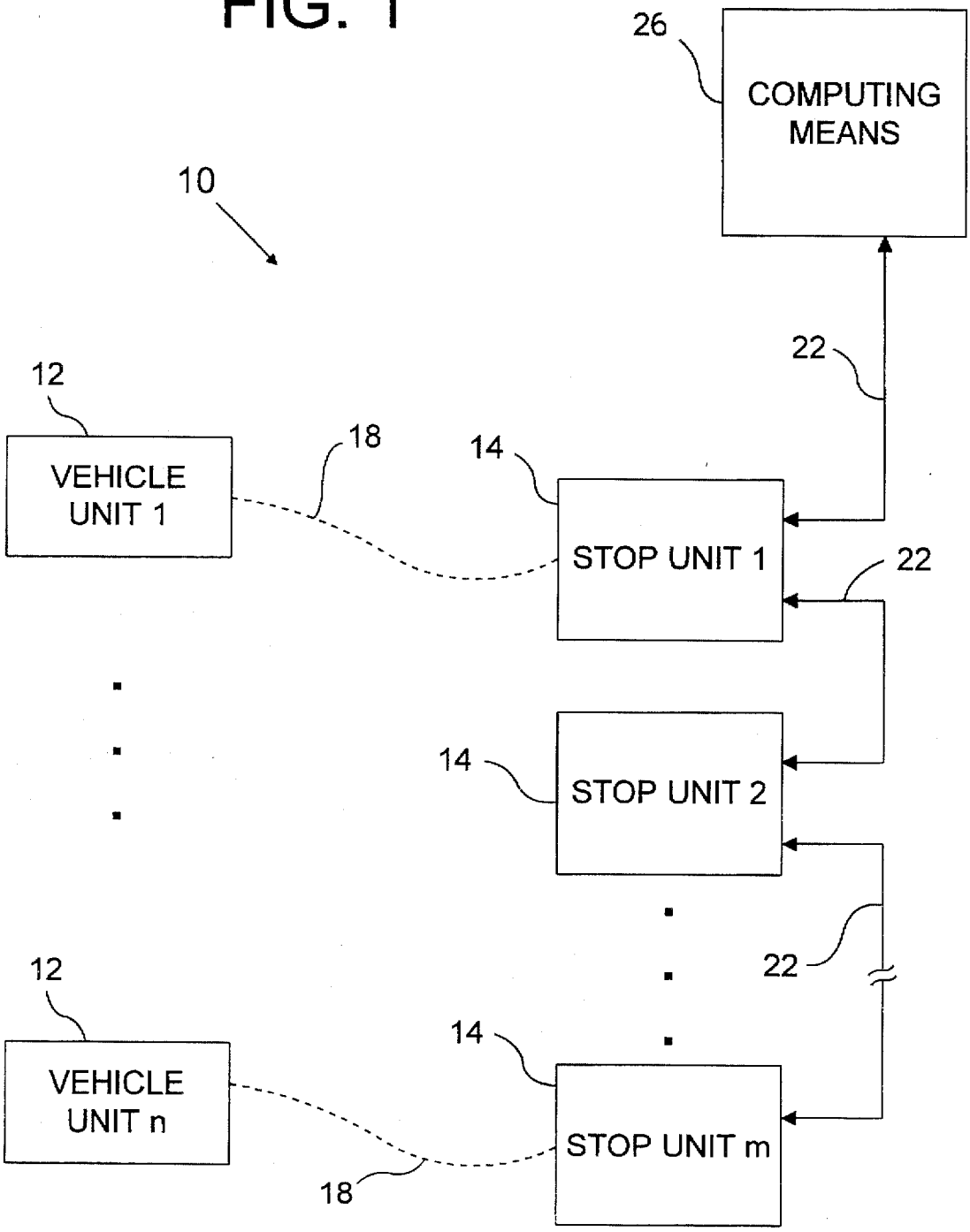
FIG. 1 provides a block diagram of an embodiment of a mass transit control and monitoring system, including the major components, in accordance with the invention.

Referring now to FIG. 1, there is shown in accordance with the present invention an embodiment of a mass transit control system 10. The system 10, which is illustrated by way of a high level block diagram, is arranged to monitor and coordinate the movement of mass transit vehicular traffic, and also to disseminate information related to the arrival of mass transit passenger vehicles at predetermined passenger drop-off and pickup stops as the respective vehicles traverse predefined routes. The routes are defined and exist within a network of pathways, such as roadways, and include a plurality of the passenger stops within the network (i.e. within the area or region containing the network of pathways). The arrangement of FIG. 1 illustrates the major components of the system 10 including a plurality of vehicle units 12, a plurality of stop units 14, and computing means 26. The vehicle units 12, one installed in each of the equipped mass transit vehicles traveling on the network and moving from stop to stop along a predefined route, are configured to exchange information with the respective stop units 14 when a vehicle (and the vehicle unit installed thereon) moves within the immediate vicinity of a respective stop unit 14. The expression "within the immediate vicinity" will be defined as an appropriate distance within a one-hundred (100) meter radius of a particular or respective stop unit 14. The information exchanged between the stop units 14 and vehicle units 12, which is related to the arrival, and possibly the departure of mass transit vehicles at the respective passenger stops, is transmitted and received by way of a communication link 18. Those skilled in the art will appreciate that communication link 18 may be established by a communication module employing a number of well known and commercially available technologies. For example, the link 18 may be established by devices that employ low power RF communication techniques (such as FM or AM), optical data transmission means, or by spread-spectrum type communication means. Further, a combination of these and other techniques may be employed to establish communication link 18 so as support the reliable exchange of information between any respective vehicle unit 12 and an associated (i.e. in the immediate vicinity) respective stop unit 14.

Figure 4A:
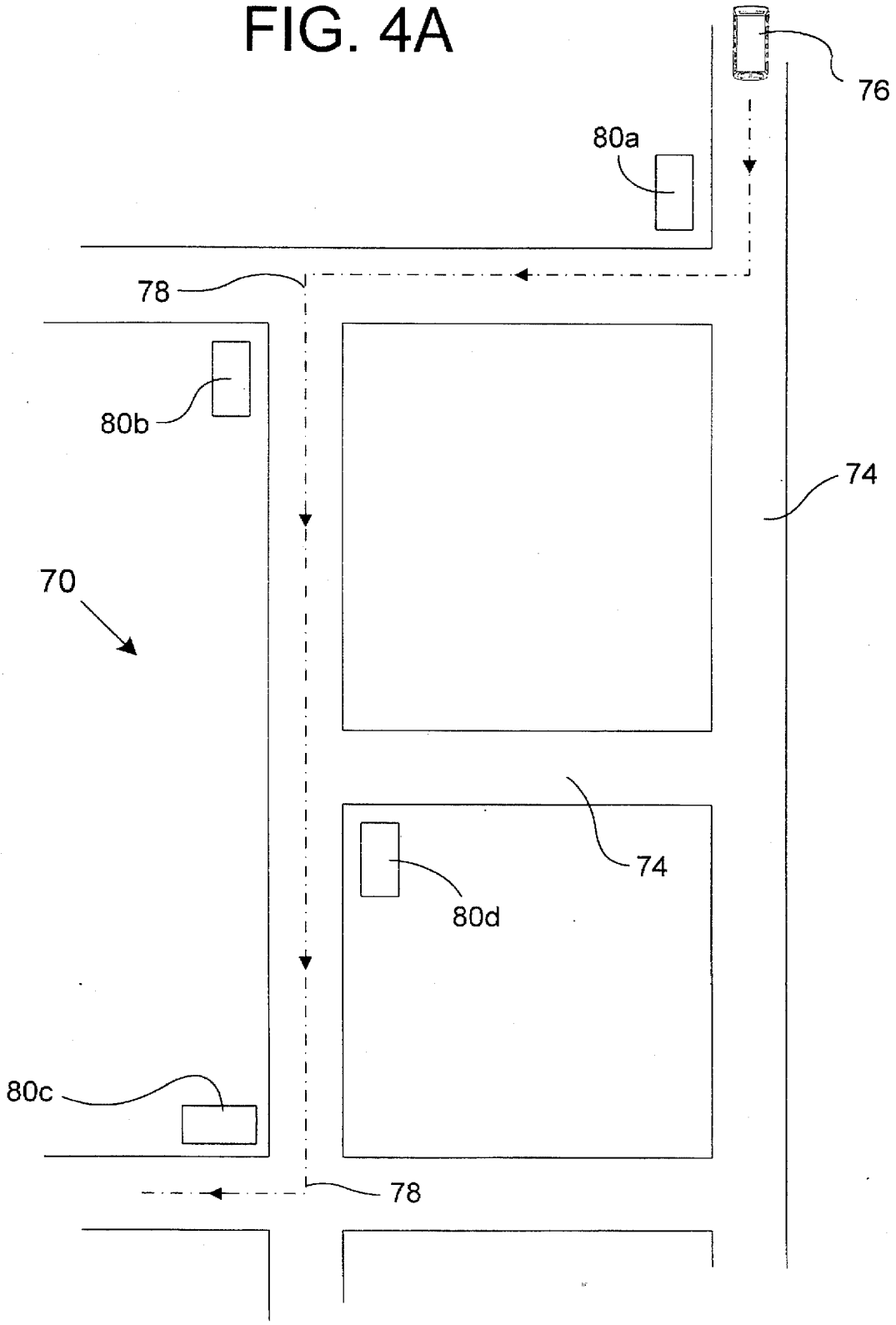
FIGS. 4A and 4B depict a plan views of a network of pathways wherein one possible route having a plurality of predetermined passenger stops has been indicated.

The computing means 26 shown in FIG. 1 is linked by coupling means 22 to a plurality of the stop units 14 so as to enable information, including information originating from one or more vehicle units 12, to be exchanged with the stop units 14. It should be understood that the phrase "a plurality of the stop units" may indicate a number of stop units which is less than the total employed in the system 10, or alternately, all of the stop units 14 of the system 10. Thus, the stop units may be "coupled" to the computing means by many different arrangements, including multi-drop networks, daisy chained (as shown) or via a suitable hierarchical coupling arrangement. The information exchanged between stop units 14 and vehicle units 12 is employed to assess and gauge the on-time status of vehicles traversing each respective route. Accordingly, such (exchanged) information may include the actual arrival time of vehicles at the respective stops, the actual time of day, the scheduled arrival time for the vehicles, a predefined stop number assigned to each passenger stop, route numbers, and schedule adjustment values. (The definition and utility of the schedule adjustment value, which is a key item utilized in the operation of the present invention, will be discussed further and in great detail when referring to FIG. 4.)

It is also the responsibility of the computing means 26 to provide the "overall functionality" for the system 10 and coordinate the operation of the major components. The required overall functionality is discussed and presented in a number of the following sections. It must be understood that computing means 26 may be realized by one large centralized computer means, such as a mainframe or mainframe cluster, or alternately, as a distributed computer system, possibly with a hierarchical structure. In a distributed and hierarchical embodiment of the computing means 26, a plurality of the stop units 14 may be linked to a local or nearby computer system (in the general vicinity of the stop units or incorporated within a modified embodiment of a stop unit). Each local computer system may then be linked to a remote and centralized computing facility, which may in turn be linked to other higher level computing means. Therefore, the computing means 26 of FIG. 1, may actually be comprised of a number of distributed computer systems connected to one or more central "higher level" computer systems. The interconnection of the computing means 26 (whether implemented by a single computer or a hierarchically organized plurality of computers) and the stop units 14 may be provided by currently available technology. In particular, the advent of high speed packet switched data networks, such as asynchronous transfer mode (ATM) systems, are capable of supporting the communications needs of the system of the present invention. In addition, should the amount of information being exchanged between stop units 14 and the computing means 26 reach the maximum capacity of the coupling means 22, a prioritization scheme may be employed to discontinue certain activities and the associated information exchanges until the volume of information being transferred drops to an appropriate level to support all activities of the system 10. An advanced technology, now readily available to support wireless local area and wide area data networking is provided by spread-spectrum technology. However, it should be noted that any suitable hardwired or wireless coupling means 22 with sufficient bandwidth that will adequately support the required information exchanges is contemplated as being within the scope of the present invention. In a preferred embodiment coupling means 22 would be provided by an optical communication means employing fiber optic components. Those skilled in the art will appreciate the availability of such components and the inherent high bandwidth optical coupling means provide.

Figure 2:
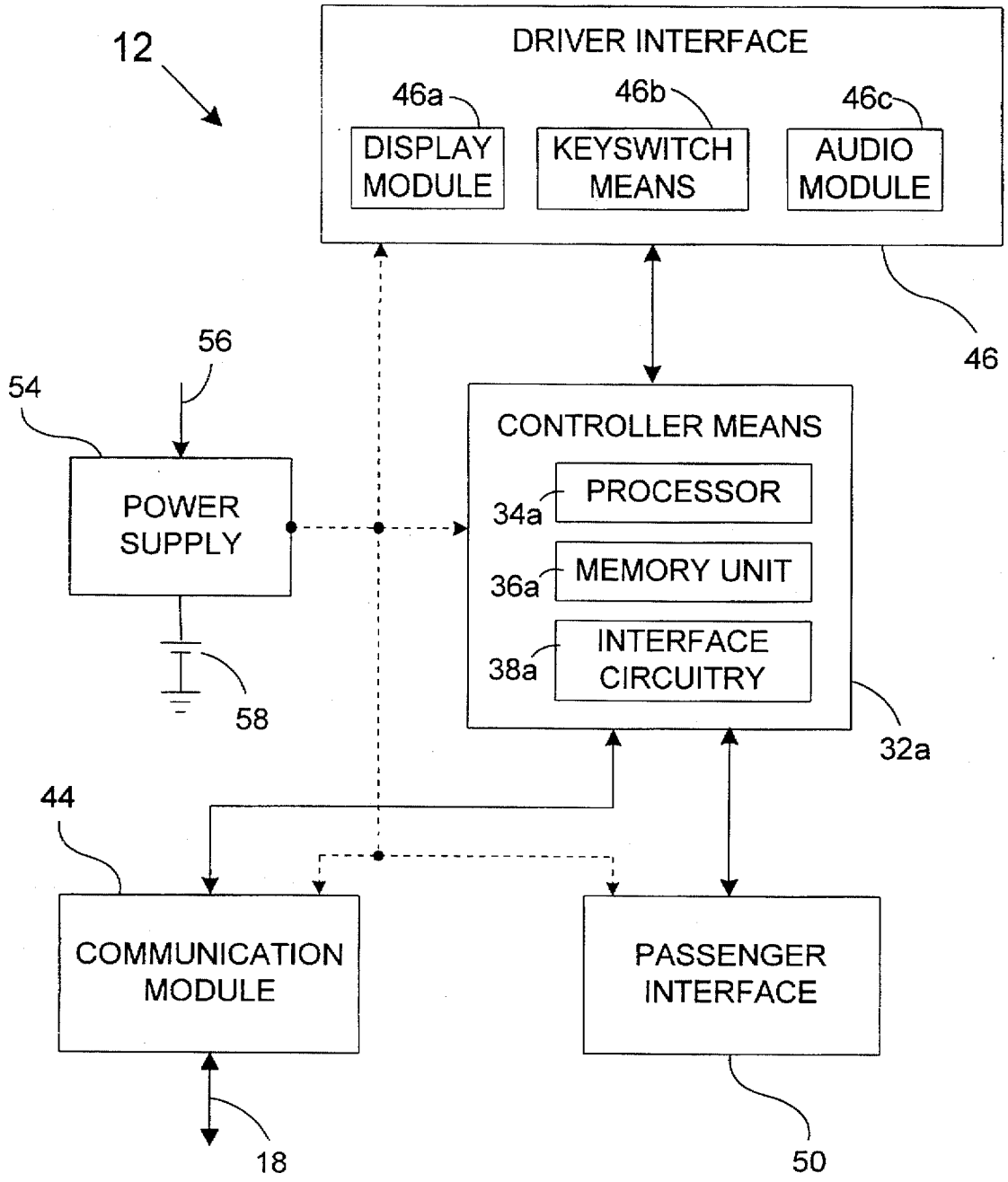
FIG. 2 shows a block diagram of an embodiment of a vehicle unit that is installed in each of a plurality of mass transit vehicles.

Referring now to FIG. 2, a block diagram of an embodiment of a vehicle unit 12 is shown. A plurality of vehicle units 12, one installed in each of the plurality of vehicles operating within the network of pathways, is provided with system 10. As shown, a controller means 32*a* includes a processor 34*a*, a memory unit 36*a*, and interface circuitry 38*a*. The controller means 32*a* is provided to supply the necessary control and computing functions, and additionally to handle the required information exchanges with the stop units 14. The processor 34*a*, which is the actual control means for the unit, may be provided in a preferred embodiment, by a suitable and commercially available single chip programmable microcontroller or microprocessor. Regardless of the actual implementation of the processor 34*a*, a memory unit 36*a* is employed to hold the application program that defines the functional characteristics of the vehicle unit 12. The memory unit 36*a* may also store constant and variable data to support proper vehicle unit 12 operation. For example, items such as the route number, the next stop number, the standard schedule for the route, and the schedule adjustment value may be stored in the memory unit 36*a*, as well as a plurality of predetermined fixed and downloaded messages. Such messages may be issued using suitable display means and audio output means. The interface circuitry 38*a* is included to functionally couple the various components of the vehicle unit 12 to the controller means 32*a*. It should be noted that in certain embodiments, the controller means may be partially or totally provided by a single chip device such as an Intel 8051 or 8096 microcontroller. In such an embodiment, wherein a single chip device is employed, the interface circuitry 38*a* may be provided to some extent or fully "on-chip".

Also shown in FIG. 2 is a communication module 44 included in this embodiment of the vehicle unit 12 to support the establishment of communication link 18. Recall, the communication link 18 is established to enable the vehicle unit 12 to exchange information with nearby (i.e. in the immediate vicinity) stop units 14. Information transmitted or received via communication module 44 may be buffered in the memory unit 36*a* of the controller means 32*a*, as required. The driver interface 46 and the passenger interface 50, which are operatively coupled to the controller means 32*a*, are provided to support the exchange of information with the driver and the dissemination of information to the passengers, respectively. The driver interface, accordingly includes well known items such as a display module 46*a* to visually issue messages to the vehicle driver, a keyswitch means 46*a* to enable the driver to input commands and the like, and an audio module 46*c* to support the issuing of audio messages and annunciations to the driver. The actual functional and operative coupling of the driver interface 46 to the controller means 32*a* may be provided by the interface circuitry 38*a*. The passenger interface 50 would enable information to be delivered to the passengers of the vehicle. For example, when approaching a passenger stop, the passenger interface 50 may display a visual message such as "Stop 15—First Avenue". At the same time, if passenger interface 50 includes an audio output means (such as a speech synthesizer and speaker), the same message may be issued as an audio message. The passenger interface 50 may also provide a means to generate audio tones, which may be issued before each message is issued or updated to attract the attention of passengers before issuing the messages.

Also shown in FIG. 2 is a power supply 54 to regulate and filter the power source 56. As the vehicle units 12 are vehicle borne, a contemplated preferred power source would be a suitable vehicle power source. A secondary power source 58 may be provided in the event that the power source 56 is disconnected or fails. The secondary power source 58 may be provided as a rechargeable battery, such as a nickel-cadmium type of battery, and may be included to retain information stored in memory unit 36*a*. Skilled individuals will be able to provide known arrangements to embody the power supply 54, as required for the proper operation of vehicle unit 12

Figure 3:
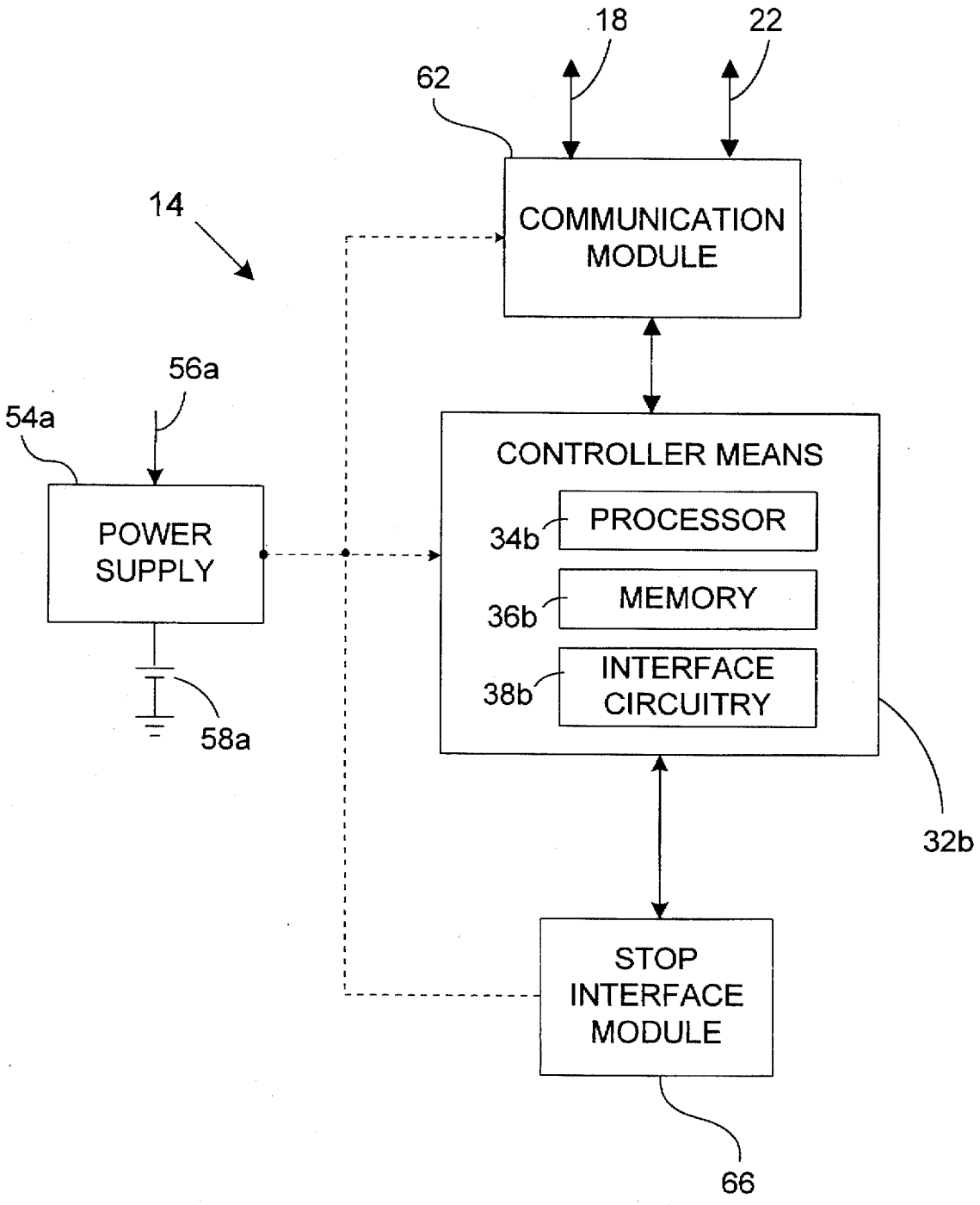
FIG. 3 is a block diagram of an embodiment of a stop unit that is installed in each of a plurality of passenger pickup and drop-off stops along a predefined route.

Referring now to FIG. 3, there is illustrated a block diagram of an embodiment of a stop unit 14. A plurality of stop units 14, one installed at each of the plurality of passenger drop-off and pickup stops within the network of pathways, are provided with system 10. The overall architecture of the stop units 14 is similar to that of the vehicle units 12. Included is a controller means 32*b* having a processor 34*b*, a memory 36*b*, and interface circuitry 38*b*. The function of controller means 32*b* is equivalent to that of controller means 32*a*. That is, the controller means 32*b* is provided to supply the necessary control and computing functions, and additionally to handle the required information exchanges with the vehicle units 12 and the computing means 26. The communication module 62 supports at least two communication interfaces, wherein one is provided to support the communication link 18 (to the vehicle units) and a second provided to support the coupling means 22. As previously discussed communication link 18 supports exchanges of information between the stop units 14 and the vehicle units 12, while the coupling means 22 enables the exchange of information between stop units 14, and between the stop units 14 and the computing means 26. In a preferred embodiment of the communication module 62, which is operatively coupled to the controller means 32*b*, two full duplex buffered interfaces would be provided to support the simultaneous transmission and reception of information from the communication link 18 and coupling means 22. Such a communication module 62 would support higher data throughput and free up the controller means 32*b* during periods of peak system activity. If buffered interfaces are provided additional memory, possibly in the form of a first-in-first-out (FIFO) memory, would be included with the communication module 62. Those skilled in the art can provide a number of suitable arrangements to embody the communications module 62.

The stop interface module 66, as shown in FIG. 3, enables the stop unit 14 to disseminate information to individuals waiting to be transported (from the respective stop). The disseminated information may include the stop number, the time of day, the route number and arrival time of one or more vehicles scheduled to arrive at the stop, as well as other suitable information. It is important to note that the arrival time may be presented as the expected time (of day) the vehicle is to arrive at the passenger stop, or equivalently as the number of time units, say minutes, until the vehicle is expected to arrive. Regardless of the method employed to indicate the expected arrival time of each vehicle, the time will be appropriately adjusted (as required) with each information exchange that is associated with each respective vehicle. The stop interface module 66 may include an audio interface to issue audio messages and a display means, such as a large character display, to issue visual messages. Such arrangements are well known to skilled individuals.

Also shown in FIG. 3 is a power supply 54*a* that is functionally equivalent to the power supply 54 of the vehicle unit 12. In the case of the power supply 54*a*, the preferred power source 56*a* would be supplied by a suitable municipal AC power source, such as the AC source used to power street lights and traffic signals. The secondary power source 58*a* may be provided in the event that the power source 56*a* is disconnected or fails. A secondary power source 58*a* may be provided to retain volatile information within the memory devices of the stop unit should the power source 56*a* fail.

Referring now to FIG. 4 there is depicted a plan view of a portion of the network of pathways 70 including a plurality of interconnected pathways 74. If the embodiment of system 10 is intended to be employed to control and monitor bus-like vehicles, pathways 74 would typically be provided by paved roadways. Illustrated is a passenger vehicle 76 that is ready to begin to traverse a predefined route 78. It should be understood that the portion of the route 78 shown includes stops 80*a*, 80*b*, and 80*c*. Other stops, such as stop 80*d*, may be present within the network and passed by traversing route 78, but not predefined to be included as a stop for route 78. Also, it can be assumed that each stop depicted in FIG. 4, is equipped with a functioning stop unit 14.

As shown in FIG. 4, vehicle 76 may be positioned at an initial starting point for the respective route to be traversed. The initial starting point may or may not be at the first stop of the route. For this example, route 78 has as its initial or first passenger stop the stop 80*a*. Once positioned at the initial starting point, the driver may wait for the scheduled start time, and then begin to traverse the route 78. At that point in time, vehicle 76 should begin to move towards stop 80*a*. Alternately, the driver may be informed via the stop unit 14 of stop 80*a* (or a separate system or device), of the exact time to begin to traverse the route 78. If a signal or message is received from the stop 80*a*, the vehicle 76 must be positioned with the immediate vicinity of the stop 80*a*, say within one-hundred (100) meters of the stop. Regardless of where the signal or message to start servicing the route originates from, at that point in time the vehicle is assumed to be on-schedule. For each stop of the route 78, the cycle of moving within the immediate vicinity of a stop, establishing a link 18 to exchange information with the respective stop, exchanging the information, arriving at the stop, picking up or dropping off passengers, and departing from the stop will typically be repeated until the entire route has been traversed and completed. Further, the departure of a vehicle from a particular stop (such as stop 80*b*) will result in the transmitting of appropriate information to each of the passenger stops that follow stop 80*b* (e.g. 80*c*), so as to enable each subsequent stop to accurately determine an expected arrival time for the vehicle. Accordingly, each departure from a passenger stop will result in the updating of estimated arrival times at all scheduled stops which follow (that stop), and may additionally result in information being sent to all past stops along the route. The past passenger stops may employ the information received from later passenger stops to avoid vehicle "bunching" along the routes (i.e. being concentrated at a point along the route) by issuing commands to other vehicles along the route in an attempt to coordinate the movements of said other vehicles in order to reduce or eliminate the bunching.

It is important to understand that the architecture of the present invention may support many methods of operation. Some methods may be structured to minimize the quantity of information exchanged between the various components of the system 10 including the stop units 14, the vehicle units 12, and the computing means 26, while other methods may be provided in which the information exchanged is significantly higher. As an example of a method which may be employed to minimize the information exchanged between the stop units 14 and the computing means 26, consider a method that provides for the daily or weekly downloading of "important" information to the each of the stop units 14 along respective routes of the network. Such information may include information related to temporary or permanent route changes, changes in the schedule for a given route, and the like. Once downloaded this information would be "locally" available to the respective stop units 14 and would not need to be accessed from the computing means 26. In addition, such download transmissions may be scheduled to occur at times when the normal information exchanges for the operation of system 10 are at a minimum—say in the very early morning hours. Therefore, having "locally" available information (stored by each stop unit 14) would mean the available bandwidth of coupling means 22 (of FIG. 1) could be fully applied to support information that "must" be transmitted between the computing means 26 and the stop units to support the operation of system 10. Examples of information that will typically need to be exchanged over the coupling means 22 would include the arrival times of vehicles at the respective passenger stations, schedule adjustment values for the vehicles, vehicle identification numbers, delays in the system due to accidents and emergencies, and the like.

Figure 4B:
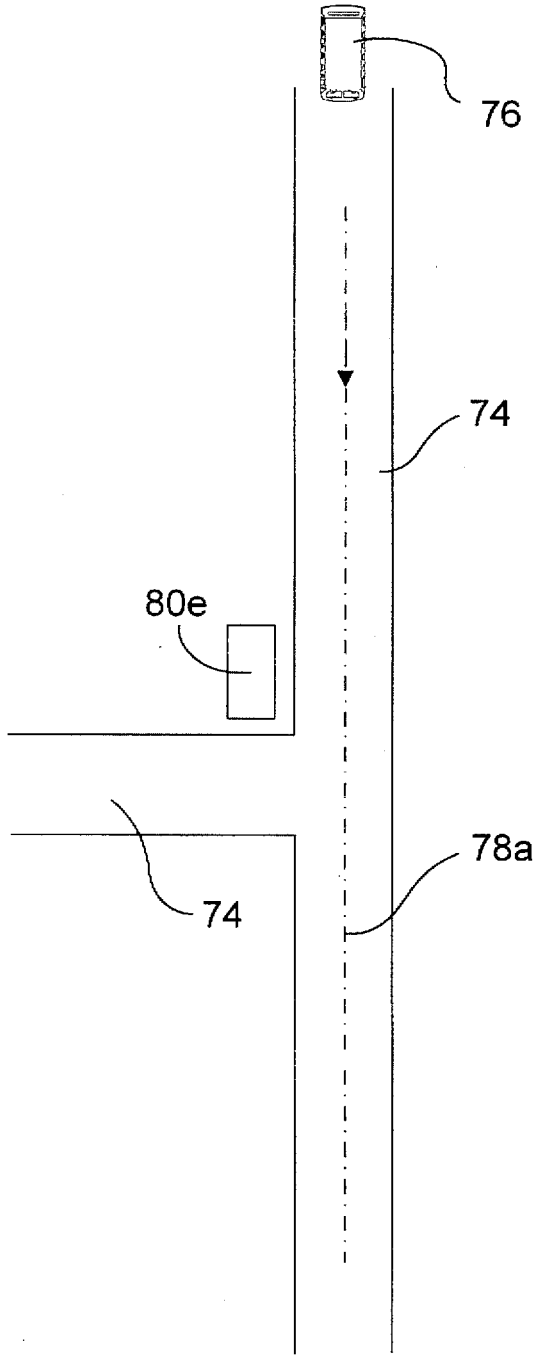

Referring now to FIG. 4B, there is illustrated a plan view of a portion of a predefined route 78, which is provided to discuss a preferred embodiment of a method of the operation for the system 10 of the invention. Assume that each vehicle in the preferred embodiment of the system 10 will transmit periodically a broadcast message, including information such as the identification number of the respective vehicle. These transmissions will occur independent of vehicle units being within the immediate vicinity of the stop unit 14. It may be noted that an acceptable periodicity for these transmissions may be in the range of approximately 1 to 3 seconds, and the transmissions may be received by any stop unit 14 within the immediate vicinity. Such transmissions may be termed a "heartbeat signal".

Referring again to FIG. 4*b*, there is illustrated a vehicle 76 traversing a route 78*a* and approaching a passenger stop 80*e*. As the vehicle 76 moves within the immediate vicinity of the stop unit 14 (not shown) of stop 80*e*, the stop unit 14 will detect the transmissions (i.e. the heartbeats) emanating from the vehicle 76, and exchange information therebetween. A unique "stop number" assigned to the particular stop will comprise part of the information communicated between the stop unit and vehicle 76. The vehicle 76 may then drop-off or pickup passengers at the stop 80*e*, the number of passengers embarking the vehicle thereat being recorded via the fare box or other suitable means so that the volume of passenger traffic at each particular stop may be used in future coordinations of vehicle schedules and routing. As the vehicle pulls away from the stop, a point in time will be reached when the vehicle 76 is not within the immediate vicinity of the stop 80*e*. Consequently the vehicle 76 will no longer be in communication with said stop unit 14. It is at this time the stop unit 14 of stop 80*e* will assume the vehicle is proceeding to the next stop, which may result additional information exchanges with other stop units 14 (of the route) and/or the computing means 26.

It must be understood that the exchanges of information discussed in the previous paragraphs will allow respective vehicles and stop units 14 to determine when the vehicles have entered the immediate vicinity of the respective stop units and when they have exited. Accordingly, such exchanges may be employed to clearly track vehicles as they traverse the respective routes. In addition, as discussed above, such transmissions may be employed to enable the "bunching" or "grouping" of vehicles traversing a respective route to be avoided. The system 12 may then issue messages to appropriate vehicle drivers of the bunched vehicles to attempt to reduce or eliminate the bunching condition along the route. The reduction of bunching will be defined as the enhancement of the temporal spacing of vehicles traversing an assigned route. For example, if each vehicle traversing a predefined route were to arrive at each stop along the route such that the time interval between successive vehicle arrivals at each respective stop are equal, no bunching condition exists. Further, "handshaking" arrangements as discussed above, wherein a first unit (i.e. the vehicle unit) receives a transmission from a second unit (i.e. the stop unit), and soon thereafter responds with an appropriate response (i.e. an acknowledge signal including the vehicle ID), are well known in the art. Skilled individuals may provide a number of possible variations to the particular embodiment provided. In addition, if several closely bunched vehicles are all within the immediate vicinity of a passenger stop, it may be necessary to employ variable delays, say randomly chosen and in the range of 0.5 to 2 seconds with a granularity of 0.1 seconds (for example). The use of such variable delays would preclude situations wherein the involved vehicles would attempt to respond simultaneously to the initial heartbeat signal from a stop unit being approached.

Referring again to FIG. 4A, the schedule adjustment value, discussed previously, may be employed to assist in keeping vehicles on schedule and further to determine if a bunching situation exists. The schedule adjustment value is determined by subtracting the scheduled arrival time (at a station) for a passenger vehicle 76 from the actual arrival time for the vehicle. For example, if vehicle 76 is expected to arrive at stop 80*b* at 4:03 PM and it arrives at 4:09 PM, the schedule adjustment value would be -6 minutes. Thus, a negative schedule adjustment value would indicate the vehicle 76 is running 6 minutes behind schedule. Accordingly, a positive schedule adjustment value would indicate a vehicle is running ahead of schedule. The schedule adjustment value may be employed to inform vehicle drivers of their on-time status by issuing an appropriate message to the driver via the driver interface 46 of the vehicle unit 12. The issuing of the negative schedule adjustment value could clearly and concisely indicate to the respective driver that the vehicle is behind schedule and the driver should attempt to make up some time by speeding up. The issuance of said schedule adjustment could also alert vehicles or stop units along the route behind the late vehicle that they should reduce the speed of subsequent vehicles to avoid bunching. In addition, the schedule adjustment value may be utilized to inform the computing means 26 of the delay of the vehicle 76 to provide updated expected arrival times at upcoming passenger stops of the route 78, and to inform the stop units 14 of past stops of the schedule adjustment value.

Figure 5A:
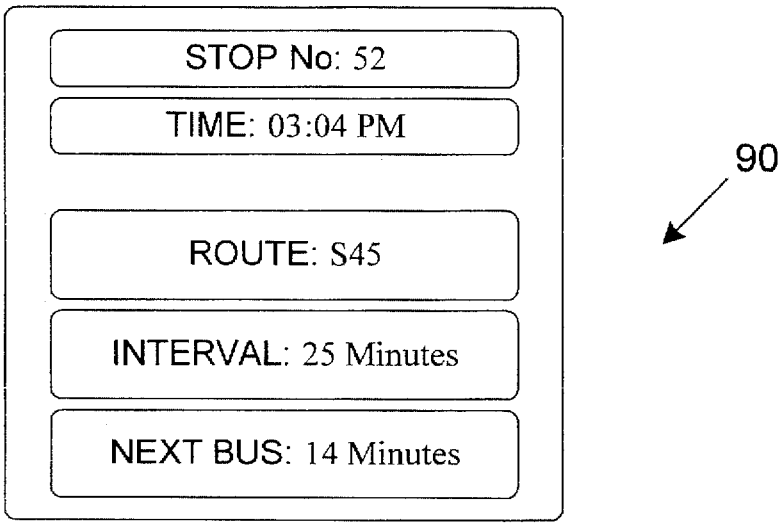
FIG. 5A provides an embodiment of a display format that may be employed to display and disseminate information to passengers waiting at the passenger stops.

Turning now to FIG. 5A, there is provided an embodiment of a display format 90 that may be employed to display and disseminate information to passengers waiting at passenger stops. As shown in FIG. 5A, the information disseminated at each passenger stop via the stop interface module 66 may include a plurality items. For example, the route number, vehicle arrival intervals, and the wait time for the next vehicle (to arrive), may be presented for a predetermined time interval. This information may then be provided for another route the stop is servicing for a predetermined period of time. Therefore, each grouped plurality of items for each route associated with the stop will be presented sequentially for a predetermined time interval. Other information such as the stop number and actual time of day will generally be continually presented. It should be understood that the display format 90 of FIG. 5A is illustrative only, and that other formats, possibly including other items, are contemplated as being within the scope of the present invention. This is especially true of items or quantities that may be determined from information exchanged between the vehicle units 12, the stop units 14, and the computing means 26. For example, delay information may also be presented via the stop interface module 66.

Figure 5B:
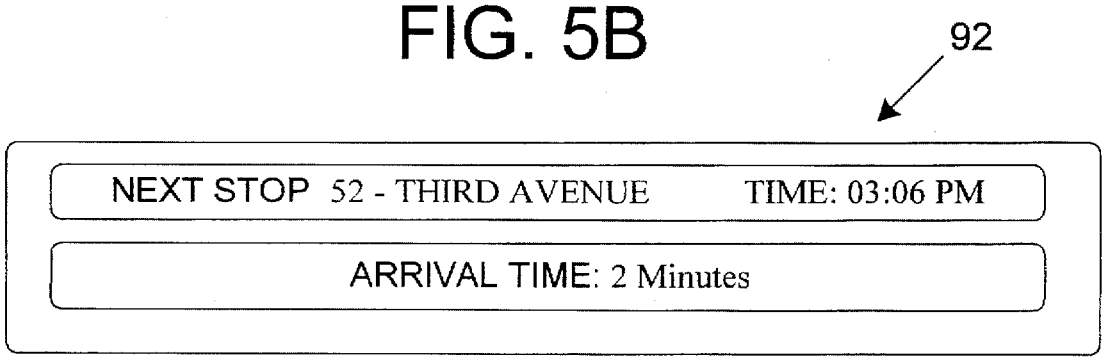
FIG. 5B provides an embodiment of a display format that may be employed to display and disseminate information to passengers being transported on a mass transit vehicle.

Referring now to FIG. 5B, there is provided an embodiment of a display format 92 that may be employed to display and disseminate information to passengers being transported on a passenger vehicle 76. The information disseminated to the passengers via the vehicle unit 12 and issued by way of a display means of the passenger interface 50, includes at least one of the stop number, the corresponding stop name, the expected vehicle arrival time at the (next) upcoming stop, and the actual time of day. The dissemination of such information to passengers of vehicle 76 would be of great help to passengers, especially those not familiar with the route being traversed.

Figure 6A:
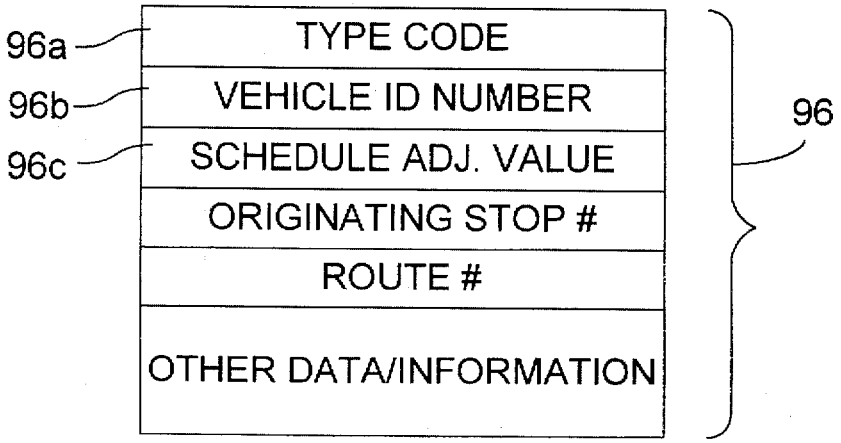
FIGS. 6A and 6B illustrate embodiments of data transmission formats that may be employed to transmit information between various components of the invention including vehicle units, stop units, and the computing means.
Figure 6B:
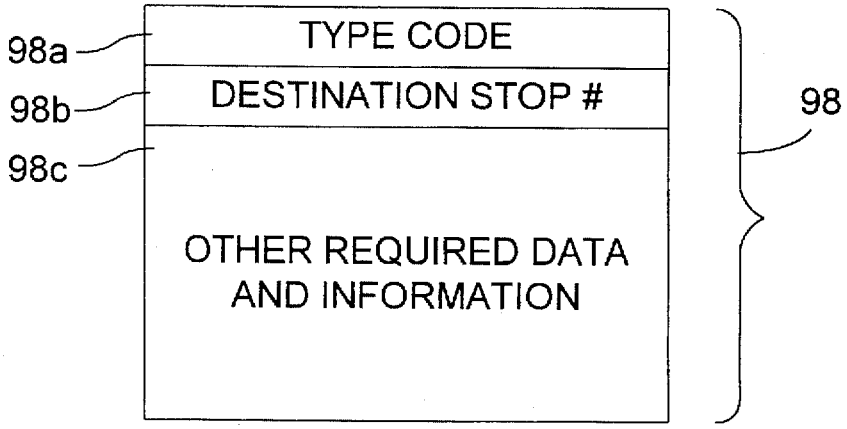

Referring now to FIGS. 6A and 6B, there are provided two possible data transmission formats 96 and 98, respectively, that may be employed to transmit information between various the components (including stop units 14, vehicle units 12, and the computing means 26) of the system 10. The data transmission formats 96 of FIG. 6A may be utilized to send information to stop units 14. The information sent may be used to update the information being disseminated to individuals by way of the stop interface module 66, as well as enable other items, such as the schedule adjustment value, to be determined. The data transmission format 96 may include a type code 96*a* to identify the packet's type, purpose and structure, a vehicle ID number 96*b* to indicate the vehicle the information is related to, a schedule adjustment value 96*c*, and other related information. Skilled persons will appreciate the number of other possible formats that may be employed to provide for the transmission of information to one or more stop units 14.

The data transmission format 98 of FIG. 6B is provided to illustrate a possible embodiment that may be employed to update information stored in the memory 36*b* of the respective stop units 14. Again, a type code 98*a* is provided to indicate to the receiving stop units 14 the type, purpose and structure of information that is being transmitted. The destination stop #98*b*, may be included to "address" one or more specific passenger stops 14 to indicate the packet 98 is intended for use by those stops. The actual information, given as 'other required data and information 98*c*', may be varied with the particular type code 98*a* supplied with data transmission packet 98. It is important to understand that the formats and organization of the data transmission formats 96 and 98 are intended to be exemplary only. Those skilled in the art will appreciate the variety of formats that may be employed.

While there have been described the currently preferred embodiments of the present invention, those skilled in the art will recognize that other and further modifications may be made without departing from the present invention and it is intended to claim all modifications and variations as fall within the scope of the invention.

What is claimed is:

1. A system to monitor and coordinate the movement of mass transit vehicular traffic on a network of pathways as a plurality of mass transit vehicles traverse predefined routes within the network, each route comprised of a plurality of predetermined passenger drop-off and pickup stops, the system comprising:

a) a plurality of stop units, one installed at each of a plurality of the passenger drop-off and pickup stops, each stop unit configured to collect and disseminate information related to vehicle arrivals at the passenger stop where the stop unit is installed;

b) a plurality of vehicle units, one installed in each of the mass transit vehicles traveling on the network, the vehicle units configured to exchange information with the stop units during the interval of time the vehicle unit is in the immediate vicinity of one of the stop units; and c) computing means to exchange information with a plurality of the stop units to determine the status and timeliness of the mass transit vehicles traversing at least one of the predefined routes, the timeliness of vehicles related to the actual time a vehicle arrives at a passenger stop with respect to the scheduled time of arrival, wherein a schedule adjustment value is determined by the computing means from the exchanged information;

d) the system suitably configured so that each mass transit vehicle having a vehicle unit and approaching a scheduled stop transmits a unique identification number comprised of a pre-defined route number and an actual initial starting time the vehicle began to traverse the route, and receives in an exchange of information with the stop unit a unique stop number which is assigned to that particular stop and stop unit.

2. The system according to claim 1 wherein upon reception of the assigned stop number of the passenger stop, the vehicle unit informs passengers of the stop number and a corresponding predefined stop name as the vehicle approaches the stop.

3. The system according to claim 1, wherein the schedule adjustment value is determined for each vehicle arriving at respective passenger stops by utilizing the information exchanged between each vehicle, the associated stop units in the vicinity thereof, and the computing means; the schedule adjustment value is determined by each stop unit transmitting the actual arrival time and the unique vehicle identification number for each vehicle that arrives at respective stops to the computing means, the computing means subtracting the actual arrival time received for each vehicle from the scheduled arrival time of the vehicle for the respective stop, and the computing means transmitting the determined schedule adjustment value back to the originating associated stop unit and all other stop units for the respective route.

4. The system according to claim 3, wherein the schedule adjustment value is used for at least one of a) informing each vehicle driver of their on-time status by issuing an appropriate message to the driver via the vehicle unit, b) informing the passengers at upcoming passenger stops along the associated route of expected arrival times of mass transit vehicles scheduled for the stops by the issuing appropriate messages via the stop units, and c) informing stop units of past stops of the schedule adjustment value.

5. The system according to claim 4 wherein the schedule adjustment value is employed to reduce the bunching of mass transit vehicles traversing the respective routes by issuing appropriate commands to at least one vehicle of a plurality of the bunched vehicles traversing each respective route.

6. The system according to claim 5 wherein the exchange of information between the computing means and a plurality of the stop units of the system is provided for by way of optical communication links.

7. A system to monitor and coordinate the movement of mass transit vehicular traffic on a network of pathways as a plurality of mass transit vehicles traverse predefined routes within the network, each route comprised of a plurality of predetermined passenger drop-off and pickup stops, the system comprising:

a) a plurality of stop units, one installed at each of the plurality of the passenger drop-off and pickup stops; each stop unit comprised of a controller means, a communication module that is responsive to the controller means to establish communication links including a short range communication link with at least one vehicle within the immediate vicinity of the stop unit, and a stop interface module coupled to the controller means to disseminate information including at least one of the stop number, the assigned route numbers associated with the stop, the mass transit vehicle arrival intervals, and the wait times for the vehicles scheduled for arrival at the respective passenger stops along at least one predefined route; each stop unit configured to collect and disseminate information related to vehicle arrivals at the passenger stop where the stop unit is installed;

b) a plurality of vehicle units, one installed in each of the mass transit vehicles traveling on the network, the vehicle units configured to exchange information with the stop units during the interval of time the vehicle unit is in the immediate vicinity of one of the stop units; and c) computing means to exchange information with a plurality of the stop units to determine the status and timeliness of the mass transit vehicles traversing at least one of the predefined routes, the timeliness of vehicles related to the actual time a vehicle arrives at a passenger stop with respect to the scheduled time of arrival, wherein a schedule adjustment value is determined by the computing means from the exchanged information;

d) the information collected by the stops units transmitted to the computing means to enable the computing means to monitor the position of each respective vehicle and determine associated deviations from a predefined schedule for each vehicle traversing each respective route, and further information disseminated at each passenger stop via the stop interface module includes a plurality of grouped items including the route number, vehicle arrival intervals, and the wait time for the next vehicle arrival, wherein each grouped plurality of items for at least one route associated with the respective stop is presented sequentially for a predetermined time interval while the stop number and actual time of day are continually presented.

8. The system according to claim 7, wherein the vehicle units are comprised of a controller means, a communication module that is responsive to the controller means to establish a short range communication link with at least one stop unit within the immediate vicinity of the vehicle unit, and a driver interface responsive to the controller means to support the exchange of information between the system and the driver of each vehicle.

9. The system according to claim 8, wherein the vehicle units further include a passenger interface that is responsive to the controller means and provided to present information to passengers of the vehicles having vehicle units installed therein.

10. The system according to claim 9, wherein the passenger interface is arranged to disseminate information related to at least one upcoming passenger stop; the information including at least one of the stop number, the corresponding stop name, the expected vehicle arrival time, and the time interval until the vehicle arrives at the stop.

11. A system to determine and display expected arrival times at a plurality of passenger drop-off and pickup stops for at least one mass transit vehicle traveling on a respective predefined route within a network of pathways, each route comprised of a plurality of the predetermined passenger stops within the network, the system comprising:

a) computing means to receive and process information related to the position and timing of mass transit vehicles relative to passenger stops of the predefined routes, and transmit appropriate responses based on the received and processed information;

b) a plurality of stop units, one installed at each of the plurality of passenger stops, each stop unit configured to collect and disseminate information related to vehicle arrivals at the respective passenger stops; each stop unit comprised of a controller means, a communication module that is responsive to the controller means to establish communication links including short range communication links with vehicles within the immediate vicinity of the stop, and a stop interface module coupled to the controller means to present and disseminate information including at least one of a stop number, an assigned route number associated with the respective stop, mass transit vehicle arrival intervals, and the wait times for the vehicles scheduled for arrival at the respective passenger stops along at least one predefined route; and c) a plurality of vehicle units, one unit installed in each of a plurality of the mass transit vehicles traveling on the network, the vehicle units configured to exchange information with each of the stop units along a respective predefined route during the interval of time the vehicle unit is in the immediate vicinity of each of the stop units, the information exchanged via the short range communication links; each of the vehicle units comprised of a controller means, a communication module that is responsive to the controller means to establish the short range communication links with stop units within the immediate vicinity of the respective vehicle unit, and a driver interface coupled and responsive to the controller means to support the exchange of information between the system and the driver of each vehicle; and d) the information collected by the stops units transmitted to the computing means to enable the computing means to monitor the position of each respective vehicle and determine associated deviations from a predefined schedule for each vehicle traversing respective routes, and further information disseminated at each passenger stop via the stop interface module includes a plurality of grouped items including the route number, vehicle arrival intervals, and the wait time for the next vehicle arrival, wherein each grouped plurality of items for each route associated with the respective stop is presented sequentially for a predetermined time interval while the stop number and actual time of day are continually presented.

12. The system according to claim 11, wherein each mass transit vehicle approaching a scheduled stop transmits a unique identification number comprised of the route number and the actual initial starting time the vehicle began to traverse the route, and receives in an exchange of information with the stop unit a unique stop number which is assigned to that particular stop and stop unit.

13. The system according to claim 12 wherein upon reception of the assigned stop number of the passenger stop, the vehicle unit informs passengers of the stop number and a corresponding predefined stop name as the vehicle arrives at the stop.

* * * * *